US006166615A

United States Patent [19]

Winslow et al.

[11] Patent Number: 6,166,615

[45] Date of Patent: Dec. 26, 2000

[54] BLIND MATE NON-CRIMP PIN RF CONNECTOR

[75] Inventors: David T. Winslow, Los Angeles; Clifton Quan, Arcadia; Hernan E. Romero, Los Angeles; Claudio S. Howard, Hawthorne; Edward L. Robertson, Culver City, all of Calif.

[73] Assignee: Raytheon Company, Lexington, Mass.

[21] Appl. No.: 09/154,000

[22] Filed: Sep. 16, 1998

[51] Int. Cl.[7] ..... H01P 1/04

[52] U.S. Cl. ..... 333/260; 333/243; 439/66; 439/91; 439/248

[58] Field of Search ..... 333/243–245, 333/260; 174/90, 128.1; 439/66, 82, 86, 91, 246–248

[56] References Cited

U.S. PATENT DOCUMENTS

| | | | |
|---|---|---|---|
| 4,556,265 | 12/1985 | Cunningham | 333/260 X |
| 4,815,986 | 3/1989 | Dholoo | 439/248 |
| 4,957,456 | 9/1990 | Olson et al. | 439/578 |
| 4,988,306 | 1/1991 | Hopfer, III et al. | 439/66 |
| 5,516,303 | 5/1996 | Yohn et al. | 439/248 |
| 5,540,593 | 7/1996 | Takahashi | 439/66 |
| 5,552,752 | 9/1996 | Sturdivant et al. | 333/243 |
| 5,633,615 | 5/1997 | Quan | 333/33 |
| 5,675,302 | 10/1997 | Howard et al. | 333/243 |

FOREIGN PATENT DOCUMENTS

| | | | |
|---|---|---|---|
| 54-120891 | 9/1979 | Japan | 439/930 |

*Primary Examiner*—Paul Gensler
*Attorney, Agent, or Firm*—Leonard A. Alkov; Glenn H. Lenzen, Jr.

[57] ABSTRACT

An RF connector includes male and female connector components. The male component has a multi-diameter dielectric housing cylinder with a metal center conductor extending through an opening in the housing. The center pin extends from each end of the dielectric housing. The center pin and the dielectric housing are sized appropriately to provide a matched impedance at microwave frequencies for the use environment to which the male component is connected. The female connector component includes a dielectric body having a center cavity formed therein. A compressible wire bundle forming a compressible conductor member is recessed into the cavity. The compressible conductor protrudes from the far end of the female cavity allowing contact to a mating circuitry. The male connector component is assembled with the female component, the male center pin being brought into electrical contact with the compressible conductor member. The female connector component is not mechanically mounted to the next level of interconnect, but instead the protruding compressible conductor is brought into compressive electrical contact with a mating circuitry on the next interconnect level.

8 Claims, 3 Drawing Sheets

BLIND MATE NON-CRIMP PIN RF CONNECTOR

TECHNICAL FIELD OF THE INVENTION

This invention relates to the field of RF connectors, and more particularly to a self-aligning connector.

BACKGROUND OF THE INVENTION

Active array antenna systems provide the problem of how to simultaneously blind mount many RF connector interfaces between, say, the transmit/receive modules and the radiating elements.

A conventional contact is known as a "Gilbert" (TM) contact, which consists of a male pin that is soldered or brazed to the next level assembly. The mating contact is a pin opened up allowing the male pin to slide into it. Although widely accepted by industry, it requires a pin to be soldered or brazed at the next level of interconnect. It would therefore represent an advance in the art to provide an RF connector which does not require any special mating provisions except for a pad area.

U.S. Pat. No. 4,957,456 describes a self-aligning blind-mate RF push-on connector, but is larger than required for some applications.

It would therefore represent an advance in the art to provide a significantly smaller RF interconnect device, which is light and requires a less complex housing.

SUMMARY OF THE INVENTION

The invention is directed to a technique for providing an RF connection. A connector embodying the invention includes two basic parts, the male and female connector components. The male component comprises a multi-diameter dielectric housing cylinder with a metal center conductor extending through an opening in the housing. The center pin extends from each end of the dielectric housing. The center pin and the dielectric housing are sized appropriately to provide a matched impedance at microwave frequencies for the use environment to which the male component is connected. Typically, the center pin will form or connect to a center pin of a coaxial transmission line.

The female connector component includes a dielectric body having a center cavity formed therein. A compressible gold-plated wire bundle or button assembly, forming a compressible conductor member, is recessed into the cavity. The compressible conductor protrudes from the far end of the female cavity (i.e. the end of the housing away from the male component) allowing contact to a mating circuitry, a flat gold-plated pad for example.

The male connector component thus mates with the female component, the male center pin being brought into electrical contact with the wire button assembly of the female component. The female connector component is not mechanically mounted to the next level of interconnect, but instead the protruding compressible conductor is brought into electrical contact with a mating circuitry on the next interconnect level.

The apparatus provides a self aligning pin-to-compressible-conductor RF connection, allowing the simultaneous engagement of multiple connections across a wide area.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

An exemplary embodiment of a connector assembly 50 in accordance with the invention is illustrated in FIGS. 1–4, and comprises a male connector component 60 and a female connector component 70. The male connector component 60 is shown in the side view of FIG. 1. The female component 70 is shown in the corresponding side view of FIG. 2.

Figure 1:
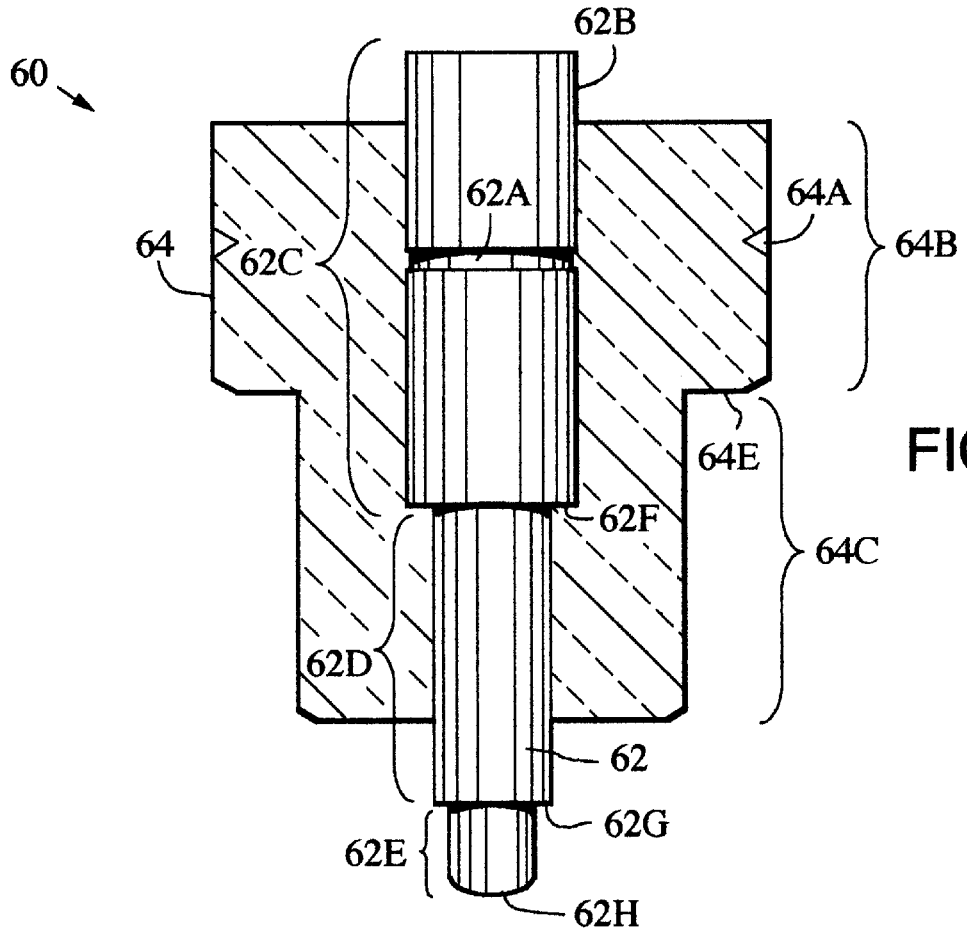
FIG. 1 is a side view of a male connector component in accordance with the invention, with one of the housing halves removed to expose the center pin.

The male component 60 comprises an electrically conductive pin 62, preferably fabricated of gold-plated or nickel-plated Beryllium copper, although other electrically conductive materials can alternatively be employed. The pin 62 is installed in a non-conductive housing 64, fabricated of a dielectric material, e.g. TEFLON (TM) to provide a matched impedance, and the respective diameters of the component elements are sized to provide a matched impedance to the use environment to which the connector is to be connected, which in an exemplary embodiment has a 50 ohm characteristic impedance. The male contact pin 62 can either be pressed into an integral housing, or sandwiched between two housing halves. The male component 60 shown in FIG. 1 is sandwiched between two halves of the housing 62, with one half of the housing removed in FIG. 1.

The dielectric housing 64 has two diameters, with a first region 64B of a first diameter adjacent end 62B of the pin 62, and a second region 64C of a second, smaller diameter adjacent end 62. A small groove 64A is machined into the outer surface of the housing 64, with another groove 62A formed in the pin 62, to maintain a specified impedance. The groove 64A in the dielectric housing mates with a ring-boss in a metal housing (described below) in which the dielectric housing will be fitted, to cause an interference fit. This allows for the male contact to be retained in the metal housing.

In this exemplary embodiment, the diameter of the pin 62 is stepped down twice to form regions of three different diameters. The region 62C of a first, largest diameter extends from the top 62B of the pin to below the shoulder 64E in the housing created by the transition in the housing from the larger diameter to the smaller diameter. The region 62D of the pin has a second diameter, and extends from the first pin region to the third region 62E, out of the housing 64. The third region 62E has the smallest diameter. Shoulders 62F, 62G are thus formed in the pin 62 at the diameter transitions. The top 62B of the pin 62 can be half-round to allow for soldering onto the next level assembly to which the component 60 is connected. The bottom part 62H of the pin 62 protrudes from the dielectric housing 64; it is this part of the pin 62 which mates with the contact of the female component 70.

Figure 2:
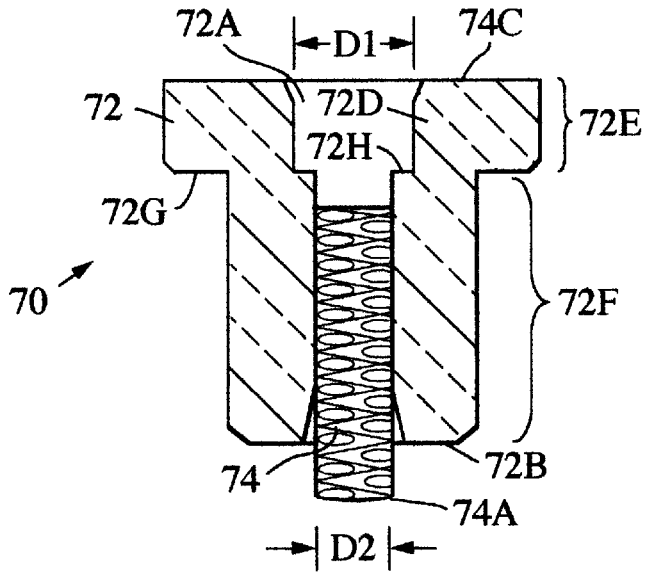
FIG. 2 is a side view of a female connector component in accordance with the invention, with one of the housing halves removed to expose the compressible center conductor.

The female component 70 includes a dielectric housing 72, fabricated of a dielectric such as TEFLON. Here again, the housing 72 can be an integral housing element or formed of two housing halves. FIG. 2 illustrates the exemplary case in which the housing 72 is formed of two housing halves. The housing 72 is also a multi-diameter element. A first region 72E has a first diameter, and a second region 72F has a second diameter which is smaller than the first diameter. A housing shoulder 72G is formed at the diameter transition.

The housing 72 has a center hole 72A formed therein. The hole is chamfered at the top end facing the male component, and has a diameter D1 which is slightly oversized relative to the second pin diameter of the pin region 62D for alignment and tolerance acceptance. The diameter of the hole is abruptly reduced at shoulder 72H to a smaller diameter D2, which is slightly oversized relative to the third pin diameter of region 62E. At the far end of the female housing, the hole 72A is tapered outwardly. As the male component is brought together with the female component, the protruding tip of the pin 62 will enter the hole 72A, until the shoulder 62G of the pin comes into contact with shoulder 72H of the female housing.

A compressible conductor member or button 74 formed, e.g. of densely packed gold-plated wire, is placed into the center hole 72A in the housing 72. Compressible conductors are described, e.g. in U.S. Pat. Nos. 5,552,752; 5,633,615; and 5,675,302. The compressible center conductor 74 protrudes slightly on the far side 72B of the housing to allow contact with the mating circuitry to which the female component is to be electrically connected. The compressible center conductor 74 is recessed within the hole 72A in the housing 72 on the top side 74C, allowing physical retention and protection of the button. The diameter of the conductor 74 and the diameters of the housings 64 and 72 can be cooperatively selected to meet a specific characteristic impedance, e.g. 50 ohms. This allows a taper or chamfer 72D in the hole 72A to help align the two mating contacts 62 and 74 during assembly. The assembly which houses the female contact may have a tapered hole to further allow the two halves to align easily.

Figure 3:
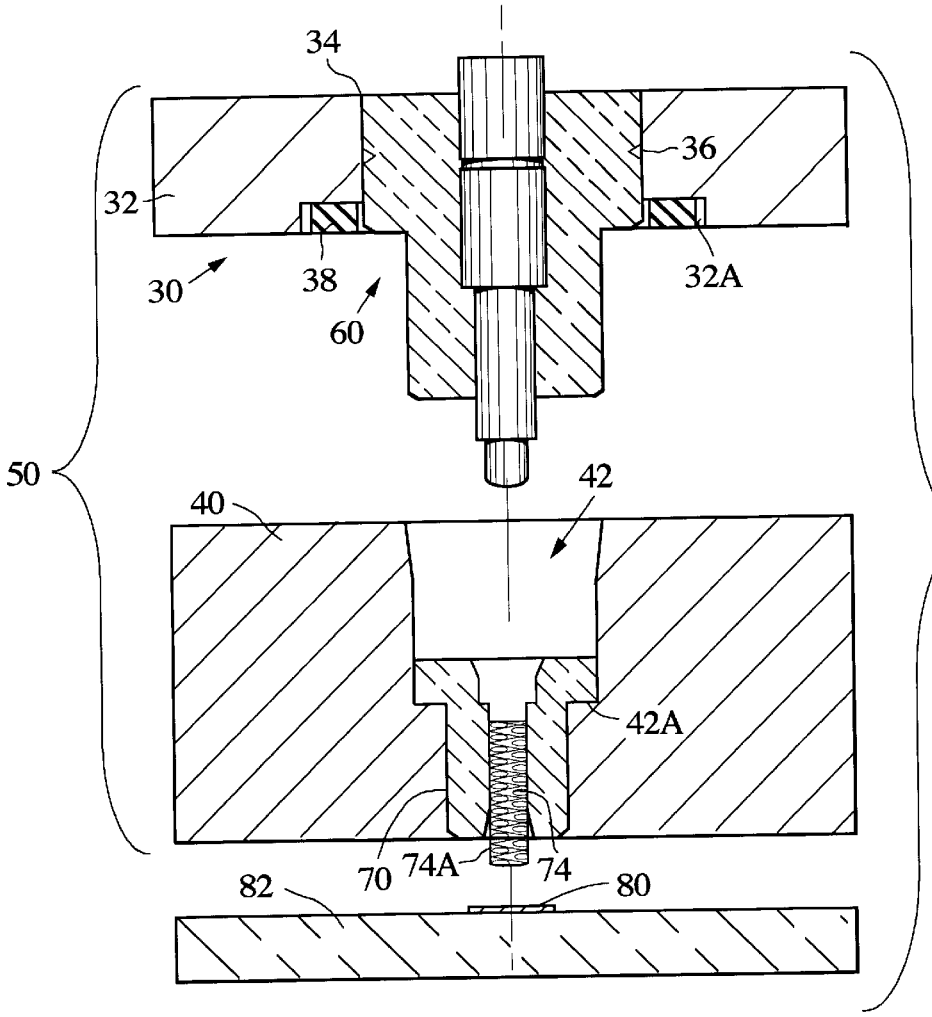
FIG. 3 is a side exploded view showing the male connector component as in FIG. 1 installed in an assembly, the female connector component as in FIG. 2 installed in a housing, and a mating circuitry mounted on a dielectric substrate.

FIG. 3 is an exploded view illustrating the connector components 60, 70 in an exemplary application. The male component 60 is mounted in an assembly 30 comprising a conductive substrate 32, e.g. fabricated of aluminum, having an opening 34 formed therein, which also defines the ring boss 36. The male component 60 is received and retained within the opening 34, by the interference fit between the ring boss 36 and the groove 64A formed in the dielectric housing 64. An RF gasket 38 is fitted to a recess 32A formed in the housing 32.

The female component 70 is installed in a conductive housing 40, e.g. fabricated of aluminum, having an opening 42. The opening 42 is chamfered to facilitate mating of the male and female components, and has a shoulder 42A defined by a reduction in the diameter of the opening, against which the shoulder 72G of the dielectric housing 72 is positioned to register the position of the component 70 in the housing 40.

Figure 4:
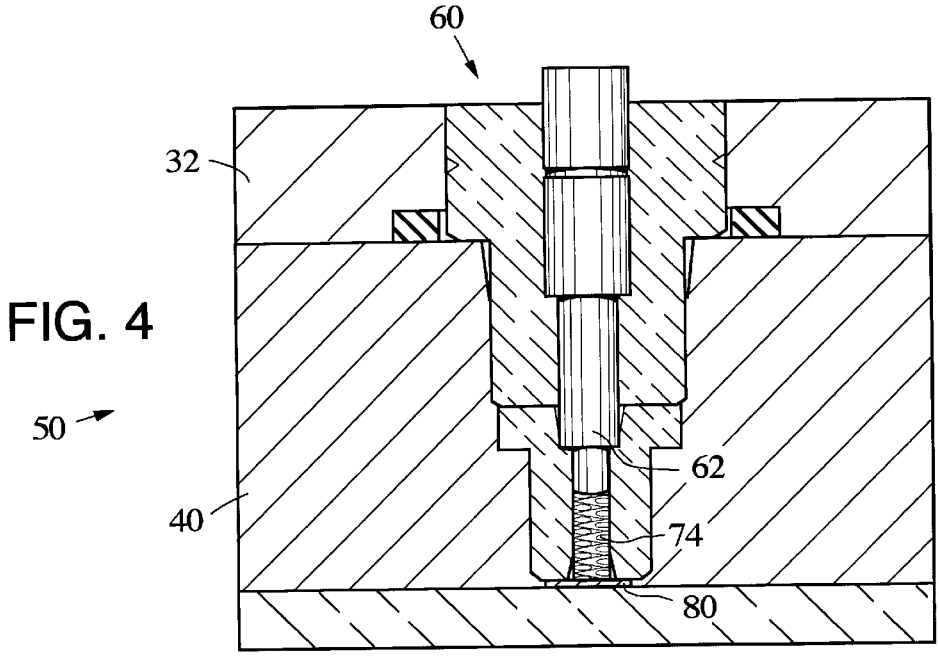
FIG. 4 shows the components of FIG. 3 in a fully assembled side cross-section view.

The mating circuitry 80 to which the protruding tip 74A of the compressible conductor 74 makes contact is mounted on a dielectric substrate 82, e.g. comprising a printed circuit board in this exemplary embodiment. FIG. 4 shows the elements of FIG. 3 in a fully assembled side cross-section view. As the male component and the female component are assembled together with the mating circuitry, the compressible conductor member 74 is compressed by the pin 62 and the conductor strip comprising the mating circuitry 80, forming RF contacts. In the assembled condition illustrated in FIG. 4, it will be seen that a coaxial connector has been formed, wherein the center conductor structure is multi-diametered, and the corresponding dielectric structure and outer conductive shielding formed by the dielectric plates 30 and 40 are also multi-diametered, forming diameter transitions at the corresponding axial positions to diameter transitions in the center conductor structure. This maintains the characteristic impedance through the connector structure.

Figure 5:
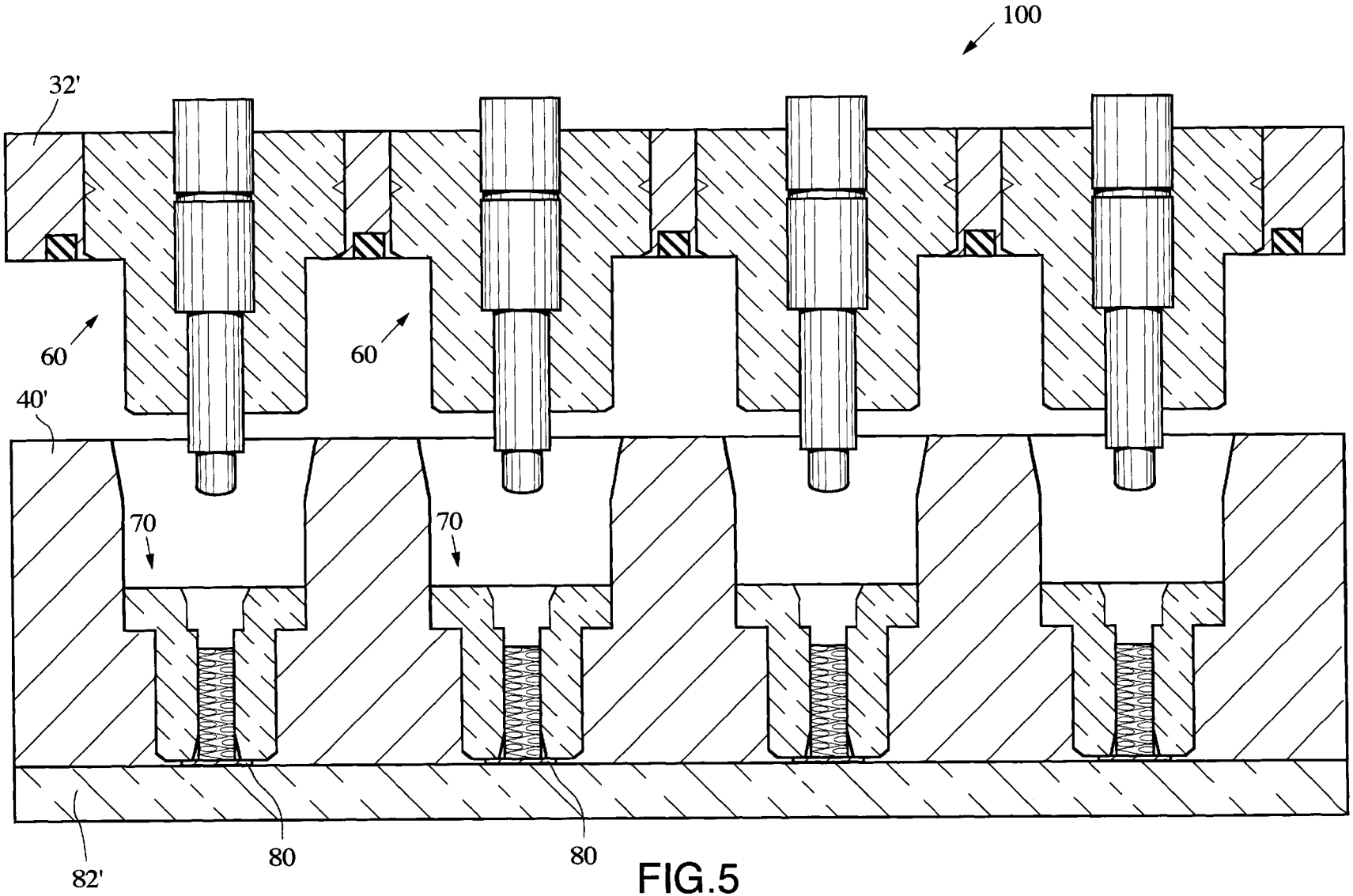
FIG. 5 shows in unassembled form a portion of a circuit employing a plurality of the connectors illustrated in FIGS. 1–4.

In an exemplary embodiment, many of the connectors will be used, e.g. in an active radar, forming connections between radiating elements of the antenna array and the transmit/receive (T/R) modules of the radar. The mating circuit 80 can connect to a T/R module, and the pin 62 can be connected to a radiating element. FIG. 5 shows in unassembled form a portion of an exemplary circuit 100 employing a plurality of the connectors, with the male components fitted into a metal plate 32' and the female components fitted into a metal plate 40'.

The new device disclosed herein in an exemplary embodiment provides a transition to a coaxial transmission line of quite small diameter. The connector device is smaller, lighter and requires a less complex housing than prior designs.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An RF connector, comprising:

a male connector component comprising a dielectric housing member and a metal center conductor extending through an opening formed in the dielectric housing member, the center conductor having a first tip portion protruding from a first surface of the housing and a second tip portion protruding from a second surface of the housing;

a female connector component comprising a dielectric body having a body opening formed therethrough, and a compressible conductor formed of thin metal wire densely packed within said body opening, and having a first end recessed into the body opening relative to a first surface of the body, and a second end protruding from the body opening relative to a second surface of the body to allow contact to a mating circuit; and an electrically conductive outer housing structure surrounding an outer periphery of the dielectric housing, wherein said outer housing structure comprises a planar plate having an opening formed therein, said male connector component disposed within said opening:

wherein the male connector component and the female connector component are cooperatively adapted so that, in an assembled condition, the first tip portion of the male conductor can be positioned in the opening formed in the dielectric body to make a first electrical contact with said first end of said compressible conductor, and said second end of said compressible conductor is adapted to make a second electrical contact with a mating electrical circuitry and wherein no solder is employed in making said first and said second electrical contacts; and wherein said dielectric housing member has a groove formed in said outer periphery, and said housing structure opening is defined by a wall having a ring boss protruding therefrom, the ring boss cooperatively adapted with the groove so that an interference fit is established between the ring boss and the groove when the housing structure is positioned within the plate opening to secure the housing structure within the plate.

2. The connector of claim 1 wherein the metal center conductor of the male connector component has radial symmetry about a center axis, said metal center conductor having a first conductor diameter over a first region, and a second conductor diameter over a second region adjacent the first region, wherein a first shoulder is formed at a boundary between the first and second region.

3. The connector of claim 2 wherein said opening formed in the dielectric housing member has radial symmetry about a center axis, said opening having a first opening diameter over a first extent and a second opening diameter over a second extent, wherein a second shoulder is formed at a boundary between said first and second extents, and said first shoulder of said center conductor is positioned against said second shoulder of said dielectric housing member.

4. The connector of claim 1 wherein said dielectric body of said female connector component has radial symmetry about a center axis, said body opening has a first diameter over a first body region, and a second diameter smaller than said first diameter over a second body region, and wherein said second tip portion of said center conductor has a first region with a first tip diameter and a distal region with a second tip diameter smaller than said first diameter, and said first region of said second tip portion is received in said first body region, and said distal region of said second tip portion is received within said second body region of said body opening to compress and make said first electrical contact with said compressible conductor.

5. The connector of claim 4 wherein said opening is chamfered to facilitate alignment of said tip portion of said center conductor during assembly of said male connector component with said female connector component.

6. The connector of claim 4 wherein said first diameter of said first body region is slightly oversized relative to said first diameter of said second tip region to provide tolerance.

7. The connector of claim 1 further comprising an electrically conductive outer housing structure surrounding a periphery of said female connector component.

8. The connector of claim 7 wherein said electrically conductive outer housing structure comprises a plate having an opening formed therethrough, said female connector component disposed within said opening.

* * * * *